US008544475B2

(12) United States Patent
Ramet

(10) Patent No.: US 8,544,475 B2
(45) Date of Patent: Oct. 1, 2013

(54) PACKAGING AND APPLICATOR ASSEMBLY INCLUDING A MAGNETIC DEVICE, A MAGNETIC DEVICE, A METHOD OF FORMING A PATTERN ON A NAIL USING A MAGNETIC DEVICE AND A METHOD OF MANUFACTURING A MAGNETIC DEVICE

(75) Inventor: Marc Ramet, Asnieres sur Seine (FR)

(73) Assignee: L'OREAL, Paris (FR)

( * ) Notice: Subject to any disclaimer, the term of this patent is extended or adjusted under 35 U.S.C. 154(b) by 664 days.

(21) Appl. No.: 11/511,324

(22) Filed: Aug. 29, 2006

(65) Prior Publication Data

US 2007/0125396 A1 Jun. 7, 2007

Related U.S. Application Data

(60) Provisional application No. 60/717,743, filed on Sep. 19, 2005.

(30) Foreign Application Priority Data

Aug. 30, 2005 (FR) ..... 05 52609

(51) Int. Cl.
*A45D 29/18* (2006.01)
*A45D 40/26* (2006.01)
*A45D 33/20* (2006.01)

(52) U.S. Cl.
USPC ..... 132/218; 132/74.5; 401/130

(58) Field of Classification Search
USPC ..... 132/218, 200, 320, 285; 283/70, 283/74, 81; 9/218, 200; 424/63
See application file for complete search history.

(56) References Cited

U.S. PATENT DOCUMENTS

| | | | | |
|---|---|---|---|---|
| 2,866,993 | A * | 1/1959 | Edelstone | 401/100 |
| 3,030,967 | A | 4/1962 | Peyron | |
| 3,461,885 | A | 8/1969 | Coveney | |
| 3,516,422 | A | 6/1970 | Bechtold et al. | |
| 3,623,732 | A | 11/1971 | Peeples | |
| 3,836,537 | A | 9/1974 | Boerwinkle et al. | |
| 3,910,862 | A | 10/1975 | Barabas et al. | |
| 3,926,659 | A | 12/1975 | Bernhard et al. | |
| 3,937,811 | A | 2/1976 | Papantoniou et al. | |
| 4,031,307 | A | 6/1977 | DeMartino et al. | |
| 4,055,377 | A | 10/1977 | Erickson et al. | |
| 4,131,576 | A | 12/1978 | Iovine et al. | |
| 4,223,009 | A | 9/1980 | Chakrabarti | |

(Continued)

FOREIGN PATENT DOCUMENTS

| | | |
|---|---|---|
| DE | 196 45 648 | 7/1997 |
| DE | 19645648 | 7/1997 |

(Continued)

OTHER PUBLICATIONS

Craft Master, 1975.*

(Continued)

*Primary Examiner* — Robyn Doan
(74) *Attorney, Agent, or Firm* — Oliff & Berridge, PLC

(57) ABSTRACT

A packaging and applicator assembly may include: a container containing a composition for application, the composition including magnetic bodies; a magnetic device configured to enable a pattern to be made on at least one layer of composition applied on keratinous materials; and at least one item of information representative of a pattern that can be made on the composition with the magnetic device.

6 Claims, 7 Drawing Sheets

(56) References Cited

U.S. PATENT DOCUMENTS 4,318,844 A 3/1982 Kohler et al.
4,425,326 A 1/1984 Guillon et al.
4,470,715 A 9/1984 Reuchlin et al.
4,693,935 A 9/1987 Mazurek
4,728,571 A 3/1988 Clemens et al.
4,972,037 A 11/1990 Garbe et al.
4,981,902 A 1/1991 Mitra et al.
4,981,903 A 1/1991 Garbe et al.
5,000,688 A * 3/1991 Clamp ..... 434/164
5,030,669 A 7/1991 Hendrickson et al.
5,040,914 A 8/1991 Fitjer
5,061,481 A 10/1991 Suzuki et al.
5,066,485 A 11/1991 Brieva et al.
5,122,418 A 6/1992 Nakane et al.
5,127,952 A 7/1992 Persello
5,133,805 A 7/1992 Kurata et al.
5,162,410 A 11/1992 Sweet
5,188,815 A 2/1993 Coates et al.
5,188,899 A 2/1993 Matsumoto et al.
5,199,808 A 4/1993 Gueret
5,206,011 A 4/1993 Pappas et al.
5,209,924 A 5/1993 Garbe et al.
5,219,560 A 6/1993 Suzuki et al.
5,291,345 A 3/1994 Umeda et al.
5,316,026 A 5/1994 Jenkins
5,330,747 A 7/1994 Krzysik
5,356,617 A 10/1994 Schlossman
5,362,485 A 11/1994 Hayama et al.
5,380,359 A 1/1995 Honda et al.
5,393,526 A 2/1995 Castro
5,424,006 A 6/1995 Murayama et al.
5,451,610 A 9/1995 Krzysik
5,468,477 A 11/1995 Kumar et al.
5,472,798 A 12/1995 Kumazawa et al.
5,486,354 A 1/1996 Defossez et al.
5,512,273 A 4/1996 Martin
5,562,706 A * 10/1996 Lauterbach et al. ..... 607/3
5,625,005 A 4/1997 Mallya et al.
5,641,835 A 6/1997 Smith et al.
5,643,672 A 7/1997 Marchi et al.
5,658,574 A 8/1997 Bahary et al.
5,683,706 A 11/1997 LaFleur et al.
5,705,093 A 1/1998 Coates et al.
5,725,483 A * 3/1998 Podolsky ..... 601/15
5,725,882 A 3/1998 Kumar et al.
5,846,310 A 12/1998 Noguchi et al.
5,849,275 A 12/1998 Calello et al.
5,849,318 A 12/1998 Imai et al.
5,851,517 A 12/1998 Mougin et al.
5,856,653 A 1/1999 Boudreaux
5,873,375 A 2/1999 Johnson et al.
5,874,069 A 2/1999 Mendolia et al.
5,913,631 A 6/1999 Landry
5,919,441 A 7/1999 Mendolia et al.
5,931,166 A 8/1999 Weber et al.
5,948,393 A 9/1999 Tomomasa et al.
5,954,871 A 9/1999 Nicolas-Morgantini et al.
5,981,680 A 11/1999 Petroff et al.
6,001,338 A 12/1999 Mondet
6,033,648 A 3/2000 Candau
6,033,650 A 3/2000 Calello et al.
6,033,655 A 3/2000 Lahanas et al.
6,051,216 A 4/2000 Barr et al.
6,071,632 A 6/2000 Hall-Goulle
6,074,654 A 6/2000 Drechsler et al.
6,117,435 A 9/2000 Painter et al.
6,117,574 A 9/2000 Watanabe et al.
6,136,907 A 10/2000 Sunamori et al.
6,177,093 B1 1/2001 Lombardi et al.
6,203,781 B1 3/2001 Chevalier et al.
6,203,909 B1 3/2001 Chassot
6,209,548 B1 4/2001 Harrison et al.
6,213,131 B1 * 4/2001 Vien et al. ..... 132/285
6,254,876 B1 7/2001 de la Poterie et al.
6,280,655 B1 8/2001 Xu et al.
6,299,979 B1 10/2001 Neubauer et al.
6,358,495 B1 3/2002 Nishihama et al.
6,387,498 B1 5/2002 Coulter et al.
6,398,713 B1 * 6/2002 Ewing et al. ..... 600/9
6,403,106 B1 6/2002 Sebag et al.
6,428,773 B1 8/2002 Oko et al.
6,432,386 B1 8/2002 Rollat-Corvol et al.
6,432,423 B1 8/2002 Maignan et al.
6,451,294 B1 9/2002 Simon
6,477,398 B1 11/2002 Mils
6,488,945 B2 12/2002 Sato
6,491,927 B1 12/2002 Arnaud et al.
6,503,761 B1 1/2003 Koenig et al.
6,517,628 B1 2/2003 Pfaff et al.
6,517,818 B1 2/2003 Golz-Berner et al.
6,545,809 B1 4/2003 Phillips
6,582,684 B1 6/2003 Abrahamson
6,589,331 B2 7/2003 Ostertag et al.
6,645,286 B2 11/2003 Ostertag et al.
6,679,825 B2 * 1/2004 Alicea ..... 600/9
6,686,397 B2 2/2004 Jaehne et al.
6,753,002 B2 6/2004 George et al.
6,846,474 B2 1/2005 Nayfeh et al.
6,884,289 B2 4/2005 Schoen et al.
7,056,498 B2 6/2006 Chevalier et al.
7,060,371 B2 6/2006 Akiyama et al.
7,258,900 B2 8/2007 Raksha et al.
7,270,770 B2 9/2007 Sage et al.
7,306,809 B2 12/2007 Sojka et al.
7,329,287 B2 2/2008 Simonet et al.
7,329,719 B2 2/2008 Pavlin
2001/0022025 A1 9/2001 Skipper
2001/0033766 A1 10/2001 Gueret
2002/0012683 A1 1/2002 Henrion et al.
2002/0015965 A1 2/2002 Sweeting
2002/0031870 A1 3/2002 Bryant
2002/0039562 A1 4/2002 Kobayashi et al.
2002/0041853 A1 4/2002 Ishii et al.
2002/0064509 A1 5/2002 Grimm et al.
2002/0070121 A1 6/2002 Nayfeh et al.
2002/0117084 A1 8/2002 Hayashi et al.
2002/0134282 A1 9/2002 Ostertag et al.
2002/0164192 A1 11/2002 Gueret
2002/0169244 A1 11/2002 Ostertag et al.
2002/0182383 A1 12/2002 Phillips et al.
2002/0182409 A1 12/2002 Gueret
2002/0192448 A1 12/2002 Schoen et al.
2003/0007942 A1 1/2003 Koenig
2003/0012752 A1 1/2003 Sara
2003/0031870 A1 2/2003 Argoitia et al.
2003/0039621 A1 2/2003 Arnaud et al.
2003/0064039 A1 4/2003 Kolodziej et al.
2003/0064086 A1 4/2003 Carrion et al.
2003/0072602 A1 4/2003 Gueret
2003/0082121 A1 5/2003 Borsakian et al.
2003/0118531 A1 6/2003 Kolodziej et al.
2003/0130323 A1 7/2003 Jaehne et al.
2003/0134761 A1 7/2003 Sebillotte-Arnaud et al.
2003/0180232 A1 9/2003 Ishii et al.
2003/0180535 A1 9/2003 Horino et al.
2003/0228339 A1 12/2003 El-Nokaly et al.
2004/0001869 A1 1/2004 Yago et al.
2004/0009309 A1 1/2004 Raksha et al.
2004/0012683 A1 1/2004 Yamasaki et al.
2004/0105827 A1 6/2004 Grimm et al.
2004/0109837 A1 6/2004 Mellul et al.
2004/0175338 A1 9/2004 Filippi et al.
2004/0228818 A1 11/2004 Simon et al.
2004/0228890 A1 11/2004 Blin et al.
2004/0241118 A1 12/2004 Simon et al.
2005/0025728 A1 2/2005 De Rigal et al.
2005/0036964 A1 2/2005 Camus et al.
2005/0118122 A1 6/2005 Simon et al.
2005/0191337 A1 9/2005 Gueret
2005/0238979 A1 10/2005 Dumousseaux
2005/0249540 A1 11/2005 Gueret
2005/0257335 A1 11/2005 Dumousseaux
2005/0257715 A1 11/2005 Dumousseaux
2005/0260146 A1 11/2005 Blin

| | | | | |
|---|---|---|---|---|
| 2005/0276767 | A1 | 12/2005 | Blin et al. | |
| 2006/0018854 | A1 | 1/2006 | Dumousseaux et al. | |
| 2006/0039876 | A1 | 2/2006 | Dumousseaux et al. | |
| 2006/0041054 | A1 | 2/2006 | Dumousseaux et al. | |
| 2006/0051382 | A1 | 3/2006 | Vidal | |
| 2006/0088484 | A1 | 4/2006 | Thevenet | |
| 2006/0099160 | A1 | 5/2006 | Dumousseaux | |
| 2006/0118663 | A1 | 6/2006 | Herzing | |
| 2006/0134044 | A1 | 6/2006 | Blin et al. | |
| 2006/0165621 | A1 | 7/2006 | Dubertret et al. | |
| 2006/0280705 | A1 | 12/2006 | Bruechert et al. | |
| 2006/0280764 | A1 | 12/2006 | Watanabe et al. | |
| 2007/0009454 | A1 | 1/2007 | Thevenet | |
| 2007/0231940 | A1 | 10/2007 | Gourlaouen et al. | |
| 2008/0014158 | A1 | 1/2008 | Lion et al. | |
| 2008/0044443 | A1 | 2/2008 | Thevenet | |
| 2008/0050324 | A1 | 2/2008 | Thevenet | |
| 2008/0105272 | A1 | 5/2008 | Thevenet | |
| 2008/0124288 | A1 * | 5/2008 | Thevenet | 424/63 |
| 2008/0127990 | A1 | 6/2008 | Thevenet | |
| 2009/0130037 | A1 | 5/2009 | Thevenet et al. | |

FOREIGN PATENT DOCUMENTS

| | | | |
|---|---|---|---|
| DE | 102 19 196 | A1 | 11/2003 |
| DE | 102 19 296 | A1 | 11/2003 |
| EP | 0 096 459 | A2 | 12/1983 |
| EP | 0 113 920 | A2 | 7/1984 |
| EP | 0 080 976 | B1 | 9/1986 |
| EP | 0 388 582 | A2 | 9/1990 |
| EP | 0 412 704 | A2 | 2/1991 |
| EP | 0 412 707 | A1 | 2/1991 |
| EP | 0 416 747 | A1 | 3/1991 |
| EP | 0 581 651 | | 2/1994 |
| EP | 0 582 152 | A2 | 2/1994 |
| EP | 0 587 908 | | 3/1994 |
| EP | 0 686 675 | A1 | 12/1995 |
| EP | 0 686 858 | | 12/1995 |
| EP | 0 749 747 | A1 | 12/1996 |
| EP | 0 815 836 | A2 | 1/1998 |
| EP | 0921217 | | 12/1998 |
| EP | 0 955 039 | B1 | 11/1999 |
| EP | 0 962 224 | A2 | 12/1999 |
| EP | 1 043 018 | A1 | 10/2000 |
| EP | 1 101 486 | A1 | 5/2001 |
| EP | 1 184 426 | B1 | 3/2002 |
| EP | 1 217 046 | A2 | 6/2002 |
| EP | 1 249 222 | A1 | 10/2002 |
| EP | 1 264 562 | A1 | 12/2002 |
| EP | 1 318 184 | A1 | 6/2003 |
| EP | 1 382 323 | A2 | 1/2004 |
| EP | 1 410 786 | A1 | 4/2004 |
| EP | 1 411 069 | A2 | 4/2004 |
| EP | 1 424 372 | | 6/2004 |
| EP | 1 440 681 | A1 | 7/2004 |
| EP | 1 510 502 | A2 | 3/2005 |
| EP | 1 591 035 | A1 | 11/2005 |
| FR | 2 077 143 | | 10/1971 |
| FR | 2 232 303 | | 1/1975 |
| FR | 2 268 512 | | 11/1975 |
| FR | 2 393 573 | | 1/1979 |
| FR | 2 594 130 | A1 | 8/1987 |
| FR | 2660842 | A1 * | 10/1991 |
| FR | 2 758 697 | | 7/1998 |
| FR | 2 845 277 | A1 | 4/2004 |
| FR | 2 845 899 | A1 | 4/2004 |
| FR | 2 846 277 | | 4/2004 |
| FR | 2 847 812 | | 6/2004 |
| FR | 2 848 821 | A1 | 6/2004 |
| FR | 2 848 826 | A1 | 6/2004 |
| FR | 2 850 271 | | 7/2004 |
| FR | 2 851 463 | A1 | 8/2004 |
| FR | 2 876 011 | | 4/2006 |
| GB | 1331819 | | 9/1973 |
| GB | 1 510 674 | | 5/1978 |
| GB | 2355987 | A | 5/2001 |
| JE | A-2005-68323 | | 3/2005 |
| JP | 51-10959 | | 4/1976 |
| JP | 51-137733 | A | 11/1976 |
| JP | S-55-81809 | | 6/1980 |
| JP | A-56-152411 | | 11/1981 |
| JP | A-58-206610 | | 12/1983 |
| JP | A-61-112008 | | 5/1986 |
| JP | 63-175670 | A | 7/1988 |
| JP | A-01-242513 | | 9/1989 |
| JP | A-1-294611 | | 11/1989 |
| JP | A-2-111340 | | 4/1990 |
| JP | A-04-108710 | | 8/1990 |
| JP | A-3-284613 | | 12/1991 |
| JP | A-03-286463 | | 12/1991 |
| JP | A-04-198117 | | 7/1992 |
| JP | A-4-292644 | | 10/1992 |
| JP | 5-17710 | | 1/1993 |
| JP | 7-258460 | | 10/1995 |
| JP | A-7-258460 | | 10/1995 |
| JP | 7-304997 | | 11/1995 |
| JP | A-7-304633 | | 11/1995 |
| JP | A-7-316015 | | 12/1995 |
| JP | A-07-324015 | | 12/1995 |
| JP | A-7-331109 | | 12/1995 |
| JP | 8-38992 | | 2/1996 |
| JP | A-8-127513 | | 5/1996 |
| JP | 9-188830 | | 7/1997 |
| JP | A-10-87437 | | 4/1998 |
| JP | 10-158540 | | 6/1998 |
| JP | 10-158541 | | 6/1998 |
| JP | A-2000-143490 | | 11/1998 |
| JP | A-11-012493 | | 1/1999 |
| JP | A-11-113631 | | 4/1999 |
| JP | A-11-181329 | | 7/1999 |
| JP | A-11-236312 | | 8/1999 |
| JP | A-2000-168667 | | 6/2000 |
| JP | A-2000-345096 | | 12/2000 |
| JP | A-2001-61550 | | 3/2001 |
| JP | A-2001-270805 | | 10/2001 |
| JP | A-2001-302432 | | 10/2001 |
| JP | A 2003-199620 | | 12/2001 |
| JP | 3286463 | | 3/2002 |
| JP | A-2002-114641 | | 4/2002 |
| JP | A-2002-138010 | | 5/2002 |
| JP | A-2002-188021 | | 7/2002 |
| JP | A-2002-194349 | | 7/2002 |
| JP | A-2002-363440 | | 12/2002 |
| JP | A-2003-000338 | | 1/2003 |
| JP | A-2003-2634 | | 1/2003 |
| JP | A-2003-24133 | | 1/2003 |
| JP | A-2003-55575 | | 2/2003 |
| JP | A-2003-125846 | | 5/2003 |
| JP | A-2003-128932 | | 5/2003 |
| JP | A-2003-160438 | | 6/2003 |
| JP | A-2004-043367 | | 2/2004 |
| JP | A-2004-043656 | | 2/2004 |
| JP | A-2004-059746 | | 2/2004 |
| JP | A-2004-123681 | | 4/2004 |
| JP | A-2004-131484 | | 4/2004 |
| JP | A-2004-512348 | | 4/2004 |
| JP | A-2004-137280 | | 5/2004 |
| JP | A-2004-231610 | | 8/2004 |
| JP | A-2004-307424 | | 11/2004 |
| JP | A-2005-516890 | | 6/2005 |
| JP | A-2005-232152 | | 9/2005 |
| WO | WO 93/23009 | | 11/1993 |
| WO | WO 93/23446 | | 11/1993 |
| WO | WO 94/26729 | | 11/1994 |
| WO | WO 95/00578 | | 1/1995 |
| WO | WO 95/03776 | | 2/1995 |
| WO | WO 95/06078 | | 3/1995 |
| WO | WO 95/23537 | | 9/1995 |
| WO | WO 96/19347 | | 6/1996 |
| WO | WO 97/35541 | | 10/1997 |
| WO | WO 99/32076 | | 7/1999 |
| WO | WO 99/36477 | | 7/1999 |
| WO | WO 99/36478 | | 7/1999 |
| WO | WO 01/38222 | A1 | 5/2001 |
| WO | WO 02/28356 | A1 | 4/2002 |
| WO | WO 02/053114 | A1 | 7/2002 |
| WO | WO 03/016429 | A1 | 2/2003 |
| WO | WO 03/020225 | A1 | 3/2003 |
| WO | WO 03020255 | A1 | 3/2003 |

| | | | |
|---|---|---|---|
| WO | WO 2004/000244 | A1 | 12/2003 |
| WO | WO 2004/007096 | | 1/2004 |
| WO | WO 2004/009044 | | 1/2004 |
| WO | WO 2004/026972 | A1 | 4/2004 |
| WO | WO 2004/028488 | A2 | 4/2004 |
| WO | WO 2006/027494 | | 3/2006 |
| WO | WO 2006/037900 | A1 | 4/2006 |
| WO | WO 2006/037902 | A1 | 4/2006 |
| WO | WO 2006/037903 | A1 | 4/2006 |
| WO | WO 2006/037906 | A1 | 4/2006 |
| WO | WO 2006/054002 | A1 | 5/2006 |

OTHER PUBLICATIONS

Eric M. Furst, "Permanently Linked Monodisperse Paramagnetic Chains," 1998, Langmuir, vol. 14, pp. 7334-7336.
C. Goubault et al., "Flexible Magnetic Filaments as Micromechanical Sensors," 2003, Physical Review Letters, vol. 91, No. 26, pp. 1-4.
International Cosmetic Ingredient Dictionary Handbook, 1997 Edition, pp. 371-386.
International Cosmetic Ingredient Dictionary Handbook, 1997 Edition, pp. 524-528.
French Search Report for French Patent Application No. FR 04/50712, priority document for co-pending U.S. Appl. No. 11/100,513, Nov. 9, 2004.
French Search Report for French Patent Application No. FR 04/50713, priority document for co-pending U.S. Appl. No. 11/100,566, Nov. 23, 2004.
French Search Report for French Patent Application No. FR 04/50714, priority document for co-pending U.S. Appl. No. 11/100,509, Nov. 10, 2004.
French Search Report for French Patent Application No. FR 04/50715, priority document for co-pending U.S. Appl. No. 11/100,514, Nov. 23, 2004.
Aug. 4, 2010 Office Action issued in U.S. Appl. No. 11/663,978.
Aug. 4, 2010 Office Action issued in U.S. Appl. No. 11/663,977.
International Search Report for PCT Application No. PCT/IB03/04306, priority document for co-pending U.S. Appl. No. 10/529,872, dated Mar. 3, 2004.
International Search Report for PCT/FR2005/050557, priority document for co-pending U.S. Appl. No. 11/242,901, Feb. 10, 2006.
Dec. 28, 2006 Office Action issued in U.S. Appl. No. 11/100,509.
U.S. Appl. No. 11/242,900, filed Oct. 5, 2005, Ludovic Thevenet.
U.S. Appl. No. 11/242,901, filed Oct. 5, 2005, Ludovic Thevenet.
U.S. Appl. No. 11/482,165, filed Jul. 7, 2006, Ludovic Thevenet.
U.S. Appl. No. 11/922,411, filed Dec. 18, 2007, Ludovic Thevenet.
U.S. Appl. No. 11/663,978, filed Aug. 16, 2007, Ludovic Thevenet.
Apr. 13, 2006 French Search Report issued in FR 0552125.
May 14, 2009 Office Action issued in U.S. Appl. No. 11/482,165.
Dec. 10, 2008 Office Action issued in U.S. Appl. No. 11/482,165.
Feb. 11, 2009 Office Action issued in U.S. Appl. No. 11/663,978.
Jun. 9, 2010 Office Action issued in U.S. Appl. No. 11/664,003.
Apr. 29, 2010 Restriction Requirement issued in U.S. Appl. No. 11/663,772.
U.S. Appl. No. 11/663,977, filed Mar. 28, 2007, Ludovic Thevenet et al.
U.S. Appl. No. 11/100,509, filed Apr. 7, 2005, Christophe Dumousseaux.
U.S. Appl. No. 11/100,513, filed Apr. 7, 2005, Christophe Dumousseaux.
U.S. Appl. No. 11/100,514, filed Apr. 7, 2005, Xavier Blin.
U.S. Appl. No. 11/100,566, filed Apr. 7, 2005, Christophe Dumousseaux.
U.S. Appl. No. 11/664,003, filed Aug. 16, 2007, Ludovic Thevenet.
U.S. Appl. No. 11/663,975, filed Aug. 16, 2007, Ludovic Thevenet.
U.S. Appl. No. 11/663,776, filed Aug. 16, 2007, Ludovic Thevenet.
U.S. Appl. No. 11/770,177, filed Jun. 28, 2007, Christophe Dumousseaux.
Aug. 16, 2007 Office Action issued in U.S. Appl. No. 11/101,400.
Aug. 12, 2009 Restriction Requirement issued in U.S. Appl. No. 11/663,977.
Jan. 15, 2009 Office Action issued in U.S. Appl. No. 11/100,514.
Jan. 21, 2010 Office Action issued in U.S. Appl. No. 11/242,901.
Jan. 22, 2009 Office Action issued in U.S. Appl. No. 11/101,400.
Jan. 27, 2009 Office Action issued in U.S. Appl. No. 11/770,177.
Jan. 7, 2009 Office Action issued in U.S. Appl. No. 11/100,566.
Jan. 8, 2009 Office Action issued in U.S. Appl. No. 11/242,901.
Jul. 10, 2009 Office Action issued in U.S. Appl. No. 11/770,177.
Jul. 7, 2009 Office Action issued in U.S. Appl. No. 11/242,901.
Jul. 9, 2009 Office Action issued in U.S. Appl. No. 11/100,566.
Jun. 23, 2008 Office Action issued in U.S. Appl. No. 11/101,399.
Jun. 23, 2008 Office Action issued in U.S. Appl. No. 11/242,901.
Jun. 24, 2008 Office Action issued in U.S. Appl. No. 11/100,566.
Jun. 24, 2008 Office Action issued in U.S. Appl. No. 11/770,177.
Jun. 26, 2008 Office Action issued in U.S. Appl. No. 11/101,398.
Mar. 19, 2009 Office Action issued in U.S. Appl. No. 11/101,398.
Mar. 19, 2009 Office Action issued in U.S. Appl. No. 11/101,399.
Mar. 20, 2008 Office Action issued in U. S. Appl. No. 11/101,400.
May 21, 2009 Office Action issued in U.S. Appl. No. 11/100,513.
Nov. 9, 2009 Office Action issued in U.S. Appl. No. 11/101,400.
Oct. 1, 2009 Office Action issued in U.S. Appl. No. 11/101,398.
Oct. 26, 2009 Office Action issued in U.S. Appl. No. 11/100,513.
Sep. 24, 2009 Office Action issued in U.S. Appl. No. 11/101,399.
Titanium Dioxide—Wikipedia (http://en.wikipedia.org/wikilTitanium_dioxide.retrieved online on Aug. 10, 2010).
Apr. 27, 2010 Office Action issued in U.S. Appl. No. 11/770,177.
Apr. 28, 2010 Office Action issued in U.S. Appl. No. 11/100,566.
Berns, Roy S.; "Billmeyer and Saltzman's Principles of Color Technology," 3rd edition 2000, John Wiley & Sons; pp. 12, 13, 138, 139.
May 31, 2006 French Search Report issued in FR 0552609.
Feb. 20, 2006 International Search Report issued in PCT/FR2005/050557.
Dec. 11, 2006 European Search Report issued in EP 06 30 0902.
Blakely, Richard J.; "Potential Theory in Gravity and Magnetic Applications," 1996, Cambridge University Press; pp. 87-90.
Dec. 19, 2006 International Search Report issued in PCT/IB2006/052239.
Jun. 30, 2010 Office Action issued in U.S. Appl. No. 11/663,776.
Jul. 23, 2010 Office Action issued in U.S. Appl. No. 11/663,772.
Jul. 23, 2010 Office Action issued in U.S. Appl. No. 11/663,975.
Pradyot Patnaik, Handbook of Inorganic Chemicals (2003), p. 945.
Oct. 19, 2009 Office Action issued in U.S. Appl. No. 11/663,776.
Oct. 21, 2009 Office Action issued in U.S. Appl. No. 11/664,003.
Oct. 27, 2009 Office Action issued in U.S. Appl. No. 11/663,977.
Oct. 27, 2009 Office Action issued in U.S. Appl. No. 11/663,978.
Hansen, C.M., "Three Dimensional Solubility Parameter—Key to Paint Component Affinities: I. Solvents, Plasticizers, Polymers, and Resins," J. Paint Tech. 39(505): 104-117 (1967).
Fermigier, et al., "Suspensions de particules magnetiques," Bulletin of the SFP (105): pp. 3-5, Jul. 1996.
"Graft Copolymers with Short Side Chains," Polymer Letters, 1967, vol. 5, pp. 477-481.
Goubault, "Colloides magnetiques: auto-organisation et applications biologiques," Doctoral Thesis of the University of Paris VI, Mar. 23, 2004.
Dec. 27, 2010 Office Action issued in U.S. Appl. No. 11/663,772.
Dec. 27, 2010 Office Action issued in U.S. Appl. No. 11/663,978.
Dec. 28, 2010 Office Action issued in U.S. Appl. No. 11/663,975.
Dec. 28, 2010 Office Action issued in U.S. Appl. No. 11/663,977.
Jan. 18, 2011 Restriction Requirement issued in U.S. Appl. No. 11/922,411.
Feb. 11, 2011 Office Action issued in U.S. Appl. No. 11/663,776.
Feb. 11, 2011 Office Action issued in U.S. Appl. No. 11/664,003.
Drahl, "Nail Polish," 2008, American Chemical Society, Chemical & Engineering News, vol. 86, No. 32, p. 42 (2 pages as supplied).
Aug. 22, 2011 Office Action issued in U.S. Appl. No. 11/663,772.
Aug. 23, 2011 Office Action issued in U.S. Appl. No. 11/663,776.
Aug. 22, 2011 Office Action issued in U.S. Appl. No. 11/663,975.
Aug. 22, 2011 Office Action issued in U.S. Appl. No. 11/663,977.
Aug. 22, 2011 Office Action issued in U.S. Appl. No. 11/663,978.
Aug. 17, 2011 Office Action issued in U.S. Appl. No. 11/664,003.
Apr. 12, 2012 Office Action issued in U.S. Appl. No. 11/663,978.
Mar. 29, 2012 Office Action issued in U.S. Appl. No. 11/663,975.
Apr. 4, 2012 Office Action issued in U.S. Appl. No. 11/663,776.
Mar. 29, 2012 Office Action issued in U.S. Appl. No. 11/663,772.
Apr. 6, 2012 Office Action issued in U.S. Appl. No. 11/664,003.
Apr. 12, 2012 Office Action issued in U.S. Appl. No. 11/663,977.

Merriam-Webster™ "Merriam-Webster's Collegiate Dictionary, 11th edition," 2003; Merriam-Websters Inc, entry for "cosmetic," Explanatory notes and p. 282.
21-USC-Chapter-9-subchapter-II, definition of "cosmetic," p. 32.
Jan. 19, 2012 Japanese Office Action issued in Japanese Patent Application No. 2008-520040 (with translation).
Jan. 18, 2012 Office Action issued in U.S. Appl. No. 11/922,411.
Definition of "soft iron", Collins English Dictionary, 5th edition (2000).
Office Action issued Aug. 30, 2012 in U.S. Appl. No. 11/663,977.
Office Action issued Aug. 30, 2012 in U.S. Appl. No. 11/663,776.
Office Action issued Aug. 30, 2012 in U.S. Appl. No. 11/663,978.
Office Action issued Aug. 30, 2012 in U.S. Appl. No. 11/664,003.
Office Action issued Aug. 30, 2012 in U.S. Appl. No. 11/242,901.
Kurtus, "Detection of a Magnetic Field," dated May 23, 2004, as captured by internet archive (<web.archive.org>) on Jun. 4, 2004 from www.school-for-champions.com/science/magnetic_detection.htm, pp. 1-5.
Roeben, "Ferreting Out Funny Money: Fighting Counterfeiting," as captured by internet archive (<web.archive.org>) on Feb. 3, 2004 from <dribbleglass.com/subpages/counterfeit.htm>, pp. 1-7.
Japanese Office Action with English-language translation for Japanese Application No. 2007-534054 mailed Oct. 7, 2010.
Mar. 8, 2013 Japanese Office Action issued in Japanese Application No. 2008-520040.
Notice of the Reasons for Rejection for corresponding Japanese Patent Application No. 2007-535205, mailed Apr. 1, 2011 (with English translation).
Notice of the Reasons for Rejection for corresponding Japanese Patent Application No. 2007-535206, mailed Feb. 21, 2011 (with English translation).
Notice of the Reasons for Rejection for corresponding Japanese Patent Application No. 2007-535204, mailed Feb. 21, 2011 (with English translation).
Notice of the Reasons for Rejection for corresponding Japanese Patent Application No. 2007-534055, mailed Jan. 20, 2011 (with English translation).
Notice of the Reasons for Rejection for corresponding Japanese Patent Application No. 2007-534056, mailed Jan. 19, 2011 (with English translation).
May 24, 2011 Office Action issued in U.S. Appl. No. 11/922,411.
Notice of the Reasons for Rejection for corresponding Japanese Patent Application No. 2007-535207, mailed Apr. 4, 2011 (with English translation).
Nov. 26, 2012 Office Action issued in U.S. Appl. No. 11/663,772.
Dye, Renee; "The Buzz on Buzz," Harvard Business Review, Nov.-Dec. 2000, issue, pp. 139-146.

* cited by examiner

FIG.28
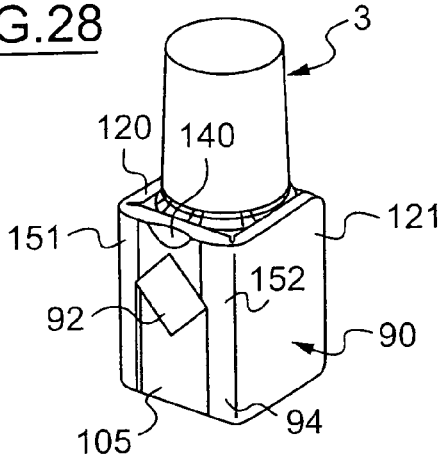
FIG.29
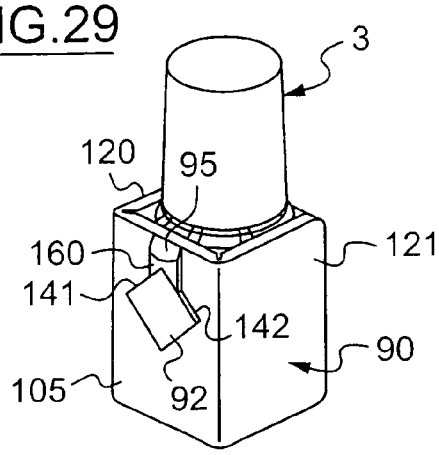
FIG.30
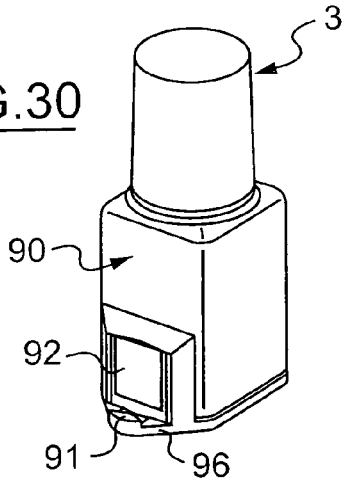
FIG.31
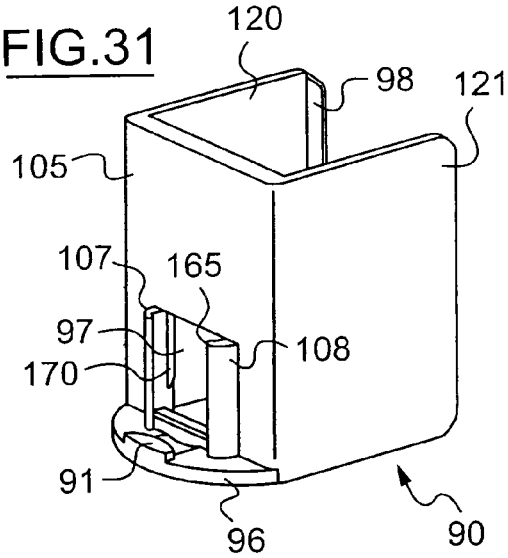
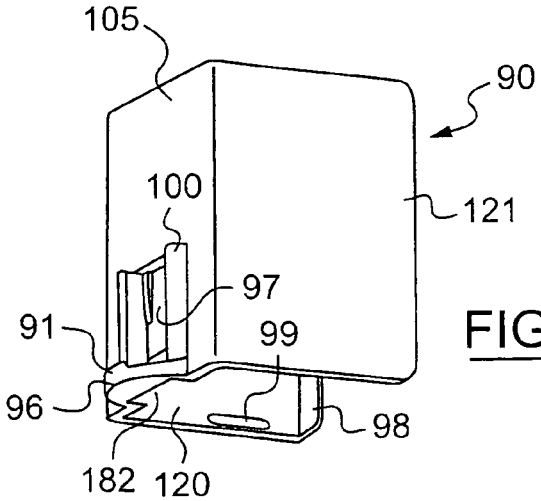
FIG.32

PACKAGING AND APPLICATOR ASSEMBLY INCLUDING A MAGNETIC DEVICE, A MAGNETIC DEVICE, A METHOD OF FORMING A PATTERN ON A NAIL USING A MAGNETIC DEVICE AND A METHOD OF MANUFACTURING A MAGNETIC DEVICE

This non-provisional application claims the benefit of French Application No. 05 52609 filed on Aug. 30, 2005 and U.S. Provisional Application No. 60/717,743 filed on Sep. 19, 2005, the entire disclosures of which are incorporated herein by reference.

BACKGROUND

The present invention relates to a packaging and applicator assembly for a cosmetic composition, and more particularly to an assembly for applying a composition that includes bodies including a non-zero magnetic susceptibility.

SUMMARY

Exemplary embodiments of the invention may provide a packaging and applicator assembly comprising: a container containing a composition for application, the composition comprising magnetic bodies, that is, bodies including a non-zero magnetic susceptibility; a magnetic device configured to enable a pattern to be made on at least one layer of composition applied on keratinous material, for example, skin, mucous membranes, hair, or nails; and at least one item of information representative of a pattern suitable for being made on the composition via the magnetic device.

In exemplary embodiments, the information may be a representation of a pattern suitable for being made on the composition via the magnetic device.

Exemplary embodiments of the invention may enable a user to create novel makeup effects, by modifying orientations of the magnetic bodies and/or by moving the magnetic bodies.

In exemplary embodiments, the item of information may be situated on the container and/or on the magnetic device.

The assembly may comprise an applicator, and the item of information may be situated on the applicator, for example, on a handle member.

In exemplary embodiments, the item of information may comprise a pattern formed at least in part by orienting the magnetic bodies under an effect of a magnetic field. For example, the assembly may comprise a deposit of composition in the form of a varnish that has been exposed to a magnetic field. In other exemplary embodiments, the assembly may comprise a thermoplastic material including magnetic bodies therein at orientations that have been modified by being exposed to a magnetic field, so as to create the pattern.

The item of information may also be formed, at least in part, by printing.

The container may comprise a compact or a flask, the information being situated on a closure member for the container, for example.

The item of information may also be contained in packaging for the container and/or the applicator, for example, being printed on instructions appearing in the packaging.

In exemplary embodiments, the composition may be a nail varnish or any other substance for application to skin, mucous membranes, hair, or nails.

The applicator may comprise an applicator member connected to a closure member configured to close the flask, and the magnetic device may be incorporated in the closure member. For example, the magnetic device may comprise a permanent magnet secured in a corresponding housing of the closure member, the magnet being held in the housing by adhesive, for example. The magnetic device may also comprise oriented magnetic particles, for example, included within a thermoplastic material or a resin.

The magnetic device may comprise an electromagnet, for example.

For example, the magnet or electromagnet may include a face that is visible and situated on a top of the closure member.

Such an assembly is practical in use, and, for example, may enable the user to expose a deposit of composition quickly to a magnetic field before the composition has dried completely.

In exemplary embodiments, the magnetic device may comprise at least one surface configured to rest against a stationary support configured to hold the magnet or the electromagnet at a predefined distance from the region on which the composition has been applied. For example, the magnetic device may include two tabs configured to rest against a horizontal plane surface in use, and configured to enable the user to slide a finger therebetween to expose the composition to the magnetic field.

The magnetic device may comprise adjustment means configured to enable the user, for example, to adjust a distance or an orientation of the magnet or electromagnet relative to the region coated in the magnetic composition.

The magnetic device may include a housing configured to enable an end of a finger to be inserted therein.

Exemplary embodiments of the invention may provide, independently or in combination with the above, a packaging and applicator device comprising: a flask containing a composition for applying to the nails; a support secured to the flask, the support carrying a magnet and including a bearing surface for a finger and/or a nail, for example, an abutment or setback, configured to enable a pattern to be formed on the nail by exposing a layer of the composition deposited on the nail to the magnetic field of the magnet; and an optional applicator, configured to be secured on the flask, the support not being secured to the applicator in use.

Exemplary embodiments of the invention may provide a magnetic device configured to enable to make a pattern on a nail on which a layer of composition comprising magnetic bodies has been deposited. Such a device may comprise: a support comprising at least a first abutment and/or a setback on which the nail and/or a finger may come to bear, the support being configured to be fixed on a flask containing the composition; at least a permanent magnet or an electromagnet positioned on the support relative to the abutment or setback in such a manner as to expose the composition deposited on the nail to a magnetic field while the nail and/or the finger is bearing against the abutment and/or setback.

Exemplary embodiments of the invention may provide a kit comprising a flask containing a composition to apply to nails and a device as defined above, fixed on the flask. The support may comprise a projection that defines a first abutment for the nail. The flask may include a body of cross-section that is generally square or rectangular. The body of the flask may be made of glass or some other material, for example, a thermoplastic material.

For example, the support may comprise two flanges united by a front upright, the flask being engaged between the flanges, the bearing surface possibly being defined by the front upright.

At least one of the flanges may comprise a rear rim configured to hold the flask between the flanges.

At least one of the flanges may comprise a portion in relief configured to enable the flask to be held stationary by snap-fastening, for example, after the flask has been inserted between the flanges by a sliding movement.

In exemplary embodiments, the support may comprise an opening configured to enable the support to be put into place on a neck of the flask. The opening may be made in a top wall that is connected at a front end thereof to the front upright of the support. The top wall may be connected at a rear end thereof to a downwardly-directed rim configured to press against a rear face of the flask.

The support may comprise a front upright that is connected at a bottom end thereof to a bottom wall configured to be positioned under the flask.

In other exemplary embodiments, the support may include a bottom wall configured to be secured to the bottom of the flask, for example, by adhesive.

Independently of its shape and the way in which it is secured to the flask, the support may comprise a housing and the magnet may be engaged at least in part in the housing, for example, being secured therein by snap-fastening and/or adhesive.

In exemplary embodiments, the housing may comprise two opposite-splines configured to retain the magnet.

For example, the magnet may be engaged in the housing by a sliding movement between the splines.

The housing may be configured to allow the magnet to be secured by snap-fastening, and at least one of the splines may comprise, for example, a lip that the magnet goes past while being put into place.

The housing may comprise at least one portion in relief, which may make it easier to bond the magnet to the housing with adhesive, for example, by serving to receive the adhesive.

The housing may open into the bottom and/or between the flanges, if any, of the support, for example, to enable the magnet to be put into place from below and/or from behind.

The bottom of the housing may be defined by a projection that may also define an abutment for a nail.

The projection may include a front edge that is rounded, being forwardly convex, or in other exemplary embodiments, a front edge that is forwardly concave. For example, a concave edge may serve to have pressed thereagainst a cuticle of the nail that is to be exposed to the magnetic field. The projection may also include a front edge that is flat or that includes some other shape.

The magnet may include a variety of shapes. For example, the magnet may be in the form of a rectangular parallelepiped.

The magnet may be disposed on the support with at least one of its sides vertical, or, in other exemplary embodiments, the magnet may include a front face in the form of a lozenge, thus configured to enable the layer of composition to be exposed to a magnetic field gradient that makes it easier to obtain makeup of the "French manicure" type.

The support may comprise a front upright including a top setback that is substantially complementary to the shape of a finger or a nail, which may be useful, for example, when the magnet includes a lozenge-shaped front face, to ensure that the nail is properly positioned.

For example, when the magnet is lozenge-shaped, the magnet may bear via two sides only against respective edges of the housing.

The magnet may be situated in a bottom half of the support, or, in other exemplary embodiments, in a top half, or indeed elsewhere.

When the magnet is situated in the bottom portion of the support, the magnet may be used with the nail pointing downward, for example, with the edge of the nail coming to bear, for example, against the projection, which may be provided with a rim configured to bear against an inside face of the nail. The support may comprise a front upright on an upper part a setback substantially complementary to the shape of finger or the nail. The magnet may bear by two sides only against an edge of a corresponding housing of the support.

The support may be secured releasably on the flask, for example, so as to enable the user to replace the flask when the composition has been used up. In other exemplary embodiments, the support may be secured to the flask in a non-removable manner.

Exemplary embodiments of the invention may provide, independently or in combination with the above, a magnetic device comprising: a support comprising at least a first abutment against which the nail and/or a finger may come to bear; at least one permanent magnet or an electromagnet positioned on the support relative to the first abutment in such a manner as to be capable of causing a deposit of composition formed on the nail to be exposed to a magnetic field when the nail and/or the finger is pressed against the abutment. For example, the magnet or electromagnet may be moved toward the deposit while the finger and/or the nail bears against the first abutment.

Such a device may make it possible to form a motif on the nail by significantly reducing any risk of accidental contact between the varnish and the magnetic device, and may it make it easier for a pattern to be provided in a reproducible manner on the nail.

The first abutment may be adjustable, where appropriate or desired, as may be the position of the magnet or electromagnet relative to the support.

The first abutment may comprise a recess configured to bear against the inside face of the nail. The recess may enable the user to pivot the support more easily relative to the nail.

For example, the support may comprises a second abutment configured to bear against a top of the finger when the nail is inserted in the magnetic field of the magnet. This second abutment may be adjustable.

For example, the first and second abutments may include curved shapes matching a curvature of the nail and/or the finger.

The support may be configured so as to be secured to a flask when not in use.

Exemplary embodiments of the invention may provide a method of forming a pattern on a nail, the method comprising: depositing on the nail a layer of composition containing magnetic bodies; and subjecting the deposited layer to a magnetic field via a magnetic device brought by a predefined movement into a vicinity of the deposited layer, for example, by a pivoting movement.

Such pivoting may be performed, for example, around a bearing surface for the nail and/or a finger against a support of the magnetic device. The magnetic device may be, for example, as defined above, including at least a first abutment for the nail and/or a finger.

Exemplary embodiments of the invention may provide a method of forming a pattern on a nail, the method comprising: depositing on the nail a layer of composition containing magnetic bodies; and subjecting the deposited layer to a magnetic field including a gradient of magnetic field so as to modify an aspect of the composition with a progressive variation of the aspect toward a free edge of the nail.

Such a method may be useful to achieve a make up of the type "French manicure."

The magnetic field may be generated, for example, by a magnet including a cuneiform portion tapering in a direction substantially parallel to a median plane of the nail.

A magnet in the form of a lozenge when the flask is vertical may be used, the nail being, for example, oriented vertically.

Exemplary embodiments of the invention may provide a magnetic device configured to enable a pattern to be formed on a nail carrying a deposit of a composition comprising magnetic bodies, the device comprising a support and at least one magnet or electromagnet carried by the support, the support including a housing configured to receive the nail and being configured to hold the magnet or electromagnet at a predefined distance from the nail in the housing.

Exemplary embodiments of the invention may provide, independently or in combination with the above, a packaging and applicator assembly comprising: a flask containing a cosmetic composition for application, the flask including a neck; a magnetic device comprising a support including an opening configured to engage on the neck and comprising at least one permanent magnet.

Such a support may serve to hold the magnetic device on the flask when not in use.

In exemplary embodiments, the packaging and applicator device may comprise a member configured to close the flask. The member may be configured to hold the support on the neck while closing the flask.

Exemplary embodiments of the invention may provide a method of fabricating a magnetic device, for example, for implementing the method of forming a pattern. The device may comprise a support and magnetic particles incorporated in the support. The support may be made of a fluid material capable of solidifying, and the particles may be oriented under an action of a magnetic field before the material of the support solidifies. After being oriented, the magnetic particles may behave like a permanent magnet.

Such a method of fabrication may make it easier to provide a magnetic device including a magnetic field of a predefined shape, for example, matching the pattern that is to be made.

In exemplary embodiments, the support may form part of an applicator for the cosmetic composition.

The term "magnetic bodies" is used to designate bodies including non-zero magnetic susceptibility, that is, bodies that are sensitive to the action of a magnetic field and that tend, for example, to align themselves with field lines. The expression "magnetic bodies" thus includes magnetizable bodies.

Preferably, the magnetic bodies used do not include any remnant magnetization in the absence of a magnetic field.

The magnetic bodies may comprise any magnetic material including sensitivity to magnetic field lines, regardless of whether the field is produced by a permanent magnet or by induction. The material may be selected, for example, from nickel, cobalt, iron, alloys and oxides thereof, for example $Fe_3O_4$, and also gadolinium, terbium, dysprosium, erbium, and alloys and oxides thereof. The magnetic material may comprise metallic iron, for example, soft iron, possibly coated.

The magnetic bodies may optionally include a multilayer structure, comprising at least one layer of a magnetic material, such as, for example, iron, nickel, cobalt, alloys and oxides thereof, and for example $Fe_3O_4$.

The magnetic bodies may preferably be aspherical, for example, including a shape that is elongate. Thus, when the bodies are subjected to the magnetic field, they may tend to become oriented with their long axes in alignment with the field lines, and may be subjected to a change of orientation that leads to a change in the appearance of the composition.

When the magnetic bodies are substantially spherical, they may preferably be of non-uniform appearance, so that a change in orientation leads to a change in appearance.

A quantity of magnetic bodies may be sufficient for the appearance of the composition to depend on the orientation and/or on the location of the magnetic bodies.

For example, a concentration in magnetic bodies may lie in a range of about 0.05% to about 97% by weight, for example, in a range of about 0.1% to about 95% by weight, better, in a range of about 0.1% to about 90% by weight, for example, about 3% by weight. For example, a size of the magnetic bodies may lie in a range of 1 nanometer (nm) to 700 micrometers (μm), better, in a range of 1 μm to 500 μm, better still, in a range of 10 μm to 150 μm. The term "size" designates a dimension given by the half-population statistical grain size distribution, known as D50.

The magnetic bodies of the composition may comprise magnetic pigments. Pigments that may be particularly suitable may include nacres comprising iron oxide $Fe_3O_4$. Pigments including magnetic properties may include, for example, those sold under the following trade names: COLORONA BLACKSTAR BLUE, COLORONA BLACKSTAR GREEN, COLORONA BLACKSTAR GOLD, COLORONA BLACKSTAR RED, CLOISONNE NU ANTIQUE SUPER GREEN, MICRONA MATTE BLACK (17437), MICA BLACK (17260), COLORONA PATINA SILVER (17289) and COLORONA PATINA GOLD (117288) from the supplier Merck or indeed FLAMENCO TWILIGHT RED, FLAMENCO TWILIGHT GREEN, FLAMENCO TWILIGHT GOLD, FLAMENCO TWILIGHT BLUE, TIMICA NU ANTIQUE SILVER 110 AB, TIMICA NU ANTIQUE GOLD 212 GB, TIMICA NU-ANTIQUE COPPER 340 AB, TIMICA NU ANTIQUE BRONZE 240 AB, CLOISONNE NU ANTIQUE GREEN 828 CB, CLOISONNE NU ANTIQUE BLUE 626 CB, GEMTONE MOONSTONE G 004, CLOISONNE NU ANTIQUE RED 424 CB, CHROMA-LITE BLACK (4498), CLOISONNE NU ANTIQUE ROUGE FLAMBE (code 440 XB), CLOISONNE NU ANTIQUE BRONZE (240 XB), CLOISONNE NU ANTIQUE GOLD (222 CB) and CLOISONNE NU ANTIQUE COPPER (340 XB) from the supplier Englehard.

Mention may also be made of black iron oxide particles sold by the supplier BASF or particles based on soft iron.

In exemplary embodiments, the magnetic bodies may be fibers.

The term "fibers" designates bodies that are generally elongate, for example, including a form factor lying in a range of 3.5 to 2500 or 5 to 500, for example, in a range of 5 to 150. Form factor is defined as the ratio L/D, where L is the length of the fiber and D is a diameter of the circle in which the largest cross-section of the fiber may be inscribed.

For example, the cross-section of the fibers may be inscribed in a circle of diameter lying in a range of 2 nm to 500 μm, for example, in a range of 100 nm to 100 μm, or indeed, 1 μm to 50 μm.

For example, the fibers may include a length lying in a range of 1 μm to 10 millimeters (mm), for example, in a range of 0.1 mm to 5 mm, or indeed, 0.3 mm to 3.5 nm.

For example, a caliber of the fibers may lie in a range of 0.15 deniers to 30 deniers (weight in grams per 9 kilometers (km) of yarn), for example, in a range of 0.18 deniers to 18 deniers.

The fibers may include a cross-section of any shape, for example, circular or polygonal, square, hexagonal, or octagonal.

The composition may comprise fibers that are solid or hollow, independent or interlinked, for example, braided.

The composition may comprise fibers including ends that have been pointed and/or rounded, for example, by polishing.

The shape of the fibers may remain substantially unchanged when introduced into the composition. For example, the fibers may be initially rectilinear and sufficiently rigid to retain their shape. In other exemplary embodiments, the fibers may include sufficient flexibility to enable them to deform substantially within the composition.

The fibers may include a non-zero content, possibly up to 100%, of a magnetic material based on iron, zinc, nickel, cobalt, or manganese, or alloys and oxides thereof, for example, $Fe_3O_4$, and rare earths, barium sulfate, silicon iron alloys, possibly filled with molybdenum, $Cu_2MnAl$, MnBi, or a mixture thereof, this list not being limiting.

When the composition comprises fibers containing magnetic particles, the magnetic particles may be located, for example, at least at the surfaces of the fibers, or else solely at the surfaces of the fibers, or barely inside the fibers, or indeed, may be dispersed throughout the fibers so as to be substantially uniform.

For example, each fiber may include a non-magnetic core with a plurality of magnetic particles in a surface thereof.

The fibers may also comprise a synthetic matrix containing a plurality of magnetic grains dispersed within the matrix.

Where appropriate or desired, the synthetic material filled with magnetic particles may itself be coated in a non-magnetic husk. For example, such a husk may comprise a barrier insulating the magnetic material(s) from the ambient medium and/or providing color. Each fiber may comprise a one-piece of magnetic core and may be coated by a non-magnetic husk, or vice versa.

The composition may comprise fibers made by extrusion or co-extrusion of one or more polymer materials, for example, thermoplastic and/or elastomer materials. One of the extruded materials may contain a filler of dispersed magnetic particles.

The fibers may comprise a synthetic material selected from: polyamides, polyethylene teraphthalate (PET), acetates, polyolefins, for example polyethylene (PE) or polypropylene (PP), polyvinyl chloride (PVC), polyester block amide, plasticized Rilsan®, elastomers, for example, polyester elastomers, PE elastomers, silicone elastomers, nitrile rubber elastomers, or a mixture of these materials, this list not being limiting.

The composition may contain composite fibers comprising a magnetic core coated at least in part by at least one non-magnetic material that is synthetic or natural. For example, the magnetic core may be coated by co-extruding a husk of non-magnetic material around the core.

The core may be coated in some other way, for example, by in situ polymerization.

The core may be monolithic, or may comprise a filler of magnetic grains dispersed within a matrix.

The composition of the core may contain composite fibers obtained by coating a synthetic or natural non-magnetic core with a synthetic material that is filled with magnetic particles, the core being constituted, for example, by fibers of wood, rayon, polyamide, plant material, polyethylene, for example, polyethylene, Nylon®, polyimide-amide, or aramid, this list not being limiting.

The composition may also comprise composite magnetic particles, for example, a magnetic latex.

A composite magnetic particle is a composite material constituted by an organic or inorganic matrix and by magnetic grains. The composite magnetic particles may thus comprise internally and/or on their surface grains of a magnetic material. The composite magnetic particles may be constituted by a magnetic core coated in an organic or inorganic matrix, or vice versa.

For example, the composite magnetic particles may comprise one of the above-mentioned magnetic materials.

For example, a dimension of the composite magnetic particles may lie in a range of 1 nm to 1 mm, better, in a range of 100 nm to 500 μm, better still, in a range 500 nm to 100 μm. The term "dimension" is used to specify the dimension given by the statistical grain size distribution at half population, known as D50.

The Mar. 23, 2004 thesis by C. Goubault, incorporated herein by reference, includes a chapter 1 summarizing the state of the art in composite magnetic particle matters, and draws up a list of methods of preparation that may be used for preparing composite magnetic particles, namely, separately synthesizing magnetic grains and the matrix, synthesizing the magnetic grains in contact with the matrix, or synthesizing the matrix in the presence of the magnetic grains.

The supplier Kisker sells mineral-matrix, composite magnetic particles made of silica. The suppliers Dynal, Seradyn, Estapor, and Ademtech propose organic-matrix composite magnetic particles that are also suitable for use in the invention.

More particularly, the supplier Estapor sells magnetic latexes under the reference M1-070/60 that are constituted by grains of ferrite uniformly distributed in a polystyrene matrix, the latex comprising 65% iron oxide, with the mean diameter of the polystyrene particles being 890 nm and the dry matter mass content being 10%.

The composition may comprise a ferrofluid, that is, any stable colloidal suspension of magnetic particles, for example, magnetic nanoparticles.

The particles, for example, of size of the order of a few tens of nanometers, may be dispersed in a solvent (water, oil, organic solvent), either with the help of a wetting or dispersing agent, or by electrostatic interactions.

For example, the ferrofluids may be prepared by grinding ferrite or other magnetic particles until nanoparticles are obtained that are subsequently dispersed in a fluid containing a wetting agent, which becomes adsorbed on the particles and stabilizes them, or by precipitating a solution of metallic ions in a basic medium.

Each particle of the ferrofluid may include a magnetic moment determined by a size of the particle and by a nature of the magnetic material.

Under an action of a magnetic field, the magnetic moments of the particles may tend to become aligned along the field lines, with a non-zero magnetization appearing in the liquid. If the field is reduced to zero, there may be no hysteresis and the magnetization may drop to zero.

Above a threshold field value, it is also possible to provoke macroscopic changes in the liquid, for example, the appearance of peaks or a change in rheological properties.

The term "ferrofluid" also covers an emulsion of droplets of ferrofluid in a solvent. Each drop then contains colloidal magnetic particles in stable suspension. This may make it possible to place a ferrofluid in any type of solvent. The dimension of the magnetic particles in suspension in the ferrofluid may lie, for example, in a range of 1 nm to 10 μm, better, in a range of 1 nm to one micrometer, better still, in a range of 1 nm to 100 nm. The term "dimension" may be used to designate the dimension given by the statistical grain size distribution at half population, known as D50.

Mention may be made, for example, of the ferrofluids sold by the supplier Liquids Research Ltd under the following references: WHKS1S9 (A, B, or C), which is an aqueous based ferrofluid including magnetite (Fe3O4), including particles with a diameter of 10 nm; WHJS1 (A, B, or C), which is an iso-paraffin based ferrofluid with particles of magnetite (Fe3O4) with a diameter of 10 nm; and BKS25-dextran, which is an aqueous based ferrofluid stabilized by dextran, including particles of magnetite (Fe3O4) with a diameter of 9 nm.

The composition may also comprise chains of particles and/or magnetic fibers.

The composition may thus comprise agglomerates of particles or fibers in which the longest dimension, for example, length, lies for example in a range of 1 nm to 10 mm, for example, in a range of 10 nm to 5 mm, or in a range of 100 nm to 1 mm, or indeed, in a range 0.5 μm to 3.5 mm, for example, in a range of 1 μm to 150 μm. The term "dimension" designates the dimension given by the statistical grain size distribution at half the population, known as D50.

For example, chains of magnetic particles may be obtained by assembling together colloidal magnetic particles, as described in the publications "Permanently linked monodisperse paramagnetic chains", by E. M Furst, C. Suzuki, M. Fermigier, A. P. Gast, Langmuir, 14, 7334-7336 (1998), "Suspensions de particules magnetiques" [Magnetic particle suspensions], by M. Fermigier, Y. Grasselli, Bulletin de la SFP (105), July 1996, and "Flexible magnetic filaments as micromechanical sensors", by C. Goubault, P. Jop, M. Fermigier, J. Baudry, E. Bertrand, J. Bibette, Phys. Rev. Lett., 91, 26, 260802-1 to 260802-4 (2003), the contents of which are incorporated by reference.

Those articles describe, for example, how to obtain chains of magnetic latex particles comprising a polystyrene matrix containing grains of iron oxide that are functionalized on the surface, being permanently bonded together following a chemical reaction, for example, involving covalent bonds between the surfaces of adjacent particles. The articles also describe a method of obtaining chains of ferrofluid emulsion droplets bonded together by interactions of a physical nature. The length and the diameter of the permanent chains as obtained in that way may be controlled. Such magnetic chains constitute anisotropic magnetic objects that may be oriented and moved under the effect of a magnetic field.

The dimensions of the magnetic chains may satisfy the same conditions as for the magnetic fibers.

The composition may comprise a physiologically acceptable medium. The term "physiologically acceptable medium" is used to designate a medium that is not toxic and that is suitable for being applied to skin, hair, nails, or lips of human beings. The physiologically acceptable medium is generally adapted to the nature of the surface on which the composition is to be applied, and to the form in which the composition is packaged.

The composition may comprise ingredients other than those described above, for example, at least one solvent, a fatty phase, a film-forming polymer, and/or a dermatologically or cosmetically active agent, depending, for example, on the galenic form in which it is provided.

The composition may comprise, for example, a volatile solvent, or a volatile organic solvent. The orientation of the magnetic body may be modified and/or the magnetic bodies may be moved before the solvent evaporates.

BRIEF DESCRIPTION OF THE DRAWINGS

Various details of the present invention may will be better understood on reading the following detailed description of non-limiting embodiments, and on examining the accompanying drawings, in which:

FIGS. 16 to 30 are perspective views of various exemplary packaging and applicator assemblies;

FIGS. 31 to 34 are perspective views illustrating, in isolation, various exemplary supports.

DETAILED DESCRIPTION OF EMBODIMENTS

Figure 1:
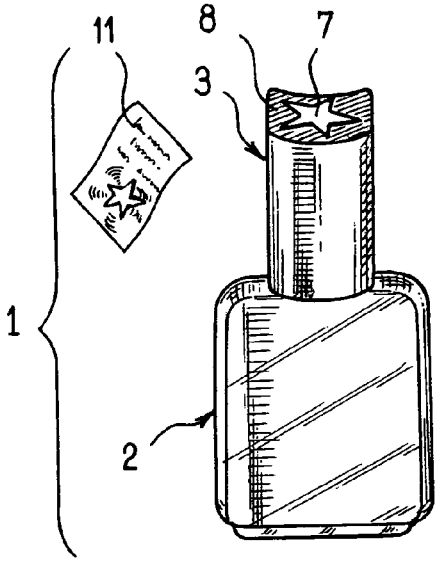
FIG. 1 is an elevation view of an exemplary packaging and applicator assembly.

FIG. 1 illustrates an exemplary packaging and applicator assembly 1 comprising a flask 2 containing a cosmetic composition and an applicator 3 configured to enable the cosmetic composition to be applied.

In the exemplary embodiment described, the cosmetic composition may comprise a nail varnish comprising magnetic bodies, and including the following formulation:

| | |
|---|---|
| Nitrocellulose | 11 |
| N-ethyl o,p-toluene sulfonamide | 5 |
| Alkyd resin | 10 |
| Isopropanol | 4 |
| Magnetic pigments* | 0.5 |
| 50/50 butyl acetate/ethyl acetate | QSP 100 |

*nacres containing at least 14% $Fe_3O_4$ of reference COLORONA PATINA GOLD (117288) sold by the supplier MERCK.

The appearance of such a nail varnish may be modified by applying a magnetic field before the varnish has had time to dry.

Naturally, the invention is not limited to one particular composition.

The applicator 3 may comprise a handle member 4, which may also constitute a closure member for the flask 2, and a brush 5 configured to enable the composition to be applied on a nail.

The assembly 1 may comprise a magnetic device, which may comprise a permanent magnet 7 integrated in the handle member 4.

In the exemplary embodiment described, the magnet 7 may be received in a housing of the handle member and may remain visible from a top face 8 of the applicator. Where appropriate or desired, the shape of the top face 8 of the applicator may be slightly concave toward the outside so as to accommodate the curvature of a nail.

The magnetic properties of the magnet 7 may be selected as a function of the pattern to be made on a nail, the concentration of magnetic bodies, and the sensitivity of the magnetic bodies. For example, the magnet 7 may generate a field of at least 500 gauss (G), preferably at least 2000 G, or even 10 000 G to 15 000 G, for example, lying in a range of 500 G to 15 000 G.

The assembly may also carry at least one piece of information representing a pattern that can be made on a deposit of the composition by using the magnetic device 7.

This information may be presented in numerous ways.

In the exemplary embodiment described, the information may appear on a label 11, for example, contained in the same package as the flask 2, the package being a cardboard box or a blister (not shown), for example.

In other exemplary embodiments, the information may appear on a label stuck onto the flask 2 or the applicator 3.

The information 11 may comprise an image of the pattern that can be obtained on the composition by using the magnetic device. This image may be obtained by printing, but may also be obtained in some other way, for example, by applying a magnetic field to a layer of the cosmetic composition, for example, deposited on the top or the side of the applicator or on the flask, in the form of a varnish.

It is also possible to mould the handle member 4 of a thermoplastic material filled with magnetic bodies and to expose the handle member 4 to a magnetic field to obtain a result that is similar to that which can be obtained by the magnetic device 7 on the composition that is contained inside the flask 2.

The assembly 1 may be used as follows.

Figure 2:
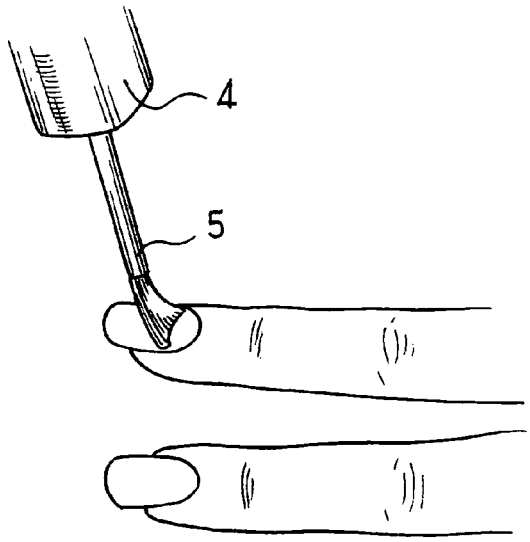
FIG. 2 illustrates composition being applied to a nail.
Figure 3:
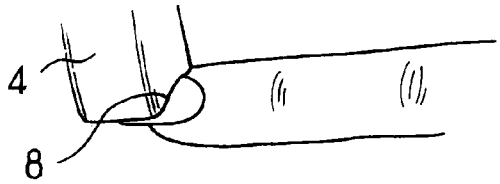
FIG. 3 illustrates exposure to a magnetic field.

The user may begin by applying the composition to a nail, as illustrated in FIG. 2. Then, before the composition dries, the user may turn the applicator 3 around to expose the composition to the magnetic field generated by the magnet 7, as illustrated in FIG. 3.

For example, the composition may be exposed to a magnetic field that is static, by not moving the magnet 7 relative to the nail until the magnetic bodies have become fixed, or that is dynamic by moving the magnet 7 relative to the nail. For example, a rotating magnetic field may create the illusion of a sphere in relief.

Figure 11:
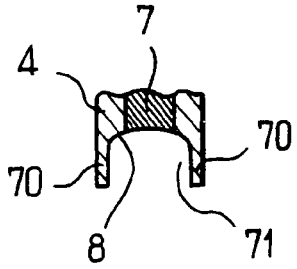
FIG. 11 is a fragmentary and diagrammatic cross-sectional view of another exemplary embodiment.

FIG. 11 illustrates the possibility of the FIG. 1 applicator 3 comprising at least one extension 70 suitable for resting against a bearing surface, for example, the top of a table, to hold the magnet 7 at a certain distance from the nail. In the exemplary embodiment shown, the applicator may comprise two tabs 70 that define a housing 71 therebetween that is suitably configured to receive the nail.

Figure 4:
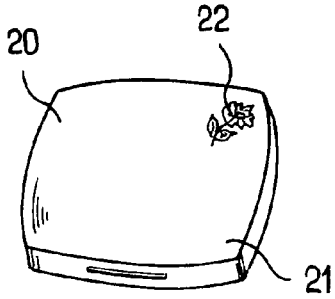
FIG. 4 illustrates an exemplary compact.
Figure 5:
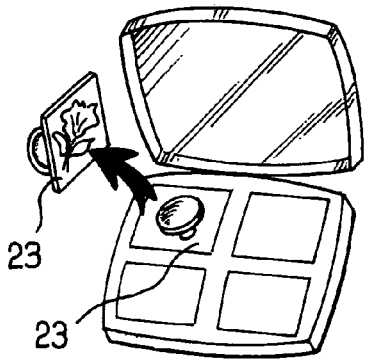
FIG. 5 illustrates the FIG. 4 compact after its lid has been opened.

FIGS. 4 and 5 illustrate an exemplary compact 20 including a lid 21 carrying information 22 representative of a pattern that can be achieved using a magnetic device 23 include in the compact 20. For example, the information 22 may be obtained by printing or may be a pattern formed in a varnish, or in the thermoplastic material of the compact 20, in the manner described above.

For example, the compact 20 may be varnished using a varnish containing magnetic bodies that are exposed before drying to a magnetic field of the kind generated by the magnetic device 23.

The compact 20 may contain a plurality of magnetic devices 23 that serve to produce different patterns, together with at least one composition for applying to skin, hair, nails, or mucous membranes.

Figure 6:
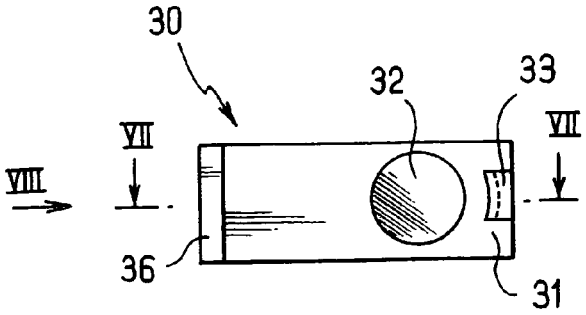
FIG. 6 is a view from below of an exemplary magnetic device configured to enable a pattern to be made on a nail.
Figure 8:
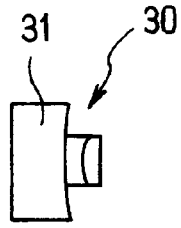
FIG. 8 is a side cross-sectional view taken along VIII-VIII of FIG. 6.
Figure 7:
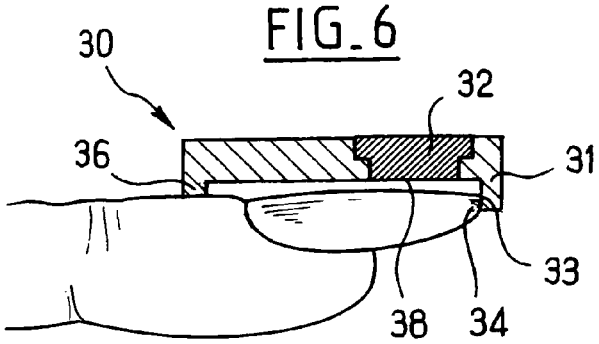
FIG. 7 is a longitudinal cross-sectional view taken along VII-VII of FIG. 6.

FIGS. 6 to 8 illustrate a device 30 for making a pattern on a nail, by applying a magnetic field to a deposit of composition including magnetic bodies.

The device 30 may comprise a support 31 and a permanent magnet 32, for example, secured on the support 31. The permanent magnet 32 may be mounted, in other exemplary embodiments (not shown), so as to be capable of moving relative to the support 31, for example, by being driven in rotation.

For example, the support 31 may be made by molding a thermoplastic material, and may comprise a first abutment 33 against which the distal end of the nail may come to bear, as illustrated in FIG. 7.

The first abutment 33 may comprise a rim 34, which may serve as a bearing surface for the undersurface of the nail, which is thus positioned both horizontally and vertically relative to the support 31, as illustrated in FIG. 7.

At an end remote from the first abutment 33, the support 31 may include a second abutment 36 that may come to bear against the top face of a finger, so as to hold the face 38 of the permanent magnet facing toward the nail and at a predefined distance from the nail, which distance may lie in a range of 0.5 mm to 1.5 mm, for example.

Like the rim 34 of the first abutment 33, the second abutment 36, for example, may include a shape that is slightly curved, adapted to the curvature of a finger, as illustrated in FIG. 8.

Figure 9:
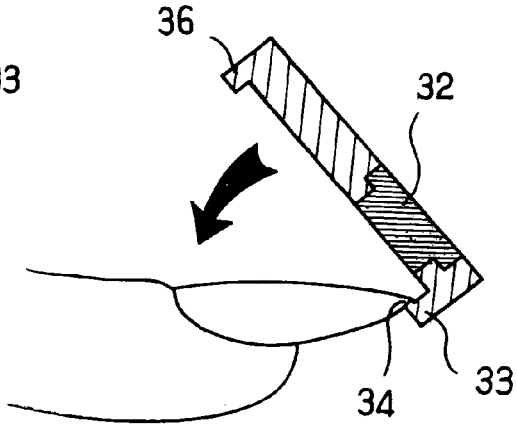
FIG. 9 is a view analogous to FIG. 7, before approaching the magnetic device.

To use the device 30, the user may begin by positioning the nail on the first abutment 33 while the support 31 is at a relatively large angle relative to the nail, as illustrated in FIG. 9, such that the composition that has been deposited on the nail is not strongly exposed to the magnetic field.

The user may then cause the support to pivot relative to the nail about a hinge axis corresponding substantially to the point where the nail bears against the first abutment 33, until the second abutment 36 comes into contact with the finger.

The user may maintain the support 31 in the FIG. 7 position for as long as is needed for the composition to dry.

Once the composition has dried, the magnetic bodies are held stationary in the orientation given to them by the magnet.

Figure 13:
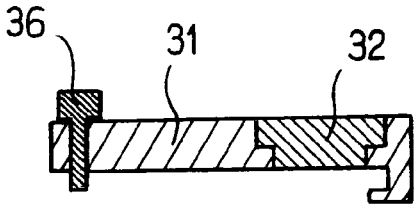
FIGS. 13 and 14 are views analogous to FIG. 7 illustrating other exemplary embodiments.

FIG. 13 illustrates an exemplary embodiment of the second abutment 36, which comes to bear against the finger, that makes it possible to adjust a height thereof. The abutment 36 in this example may comprise a screw engaged in the support 31.

Figure 10:
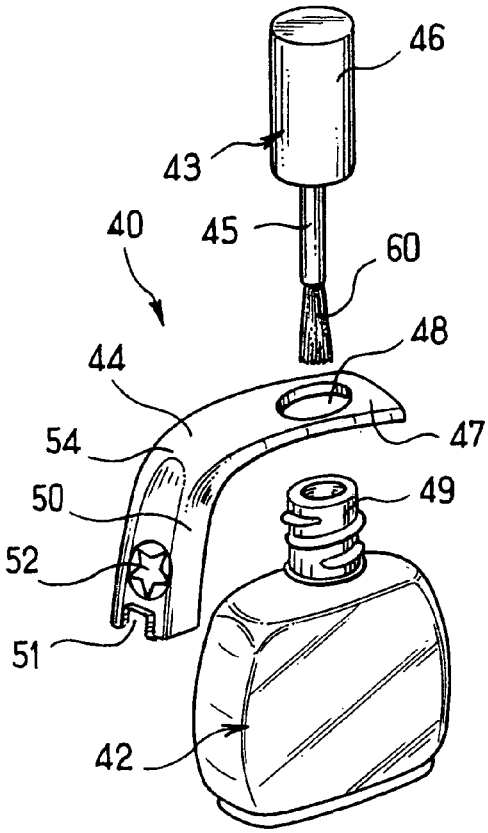
FIG. 10 is a diagrammatic perspective view of an exemplary packaging and applicator assembly.

FIG. 10 illustrates an exemplary packaging and applicator assembly 40 comprising a flask 42, an applicator 43, and a magnetic device 44.

The flask 42 may contain a cosmetic composition including magnetic bodies.

The applicator 43 may be conventional, for example, comprising an applicator element 60 such as a brush mounted at the end of a stem 45 that is connected to a handle member 46, which may also constitute a member configured to close the flask 42. The magnetic device 44 may comprise a support 47 provided with an opening 48, configured to enable the support 47 to be engaged on the neck 49 of the flask 42. The support 47 may include a lateral extension 50 that may be positioned on the side of the flask 42 and in the thickness thereof, when the neck is engaged in the opening 48 and the support 47 is held against the flask 42 by the closure member 43.

The lateral extension 50 of the support, for example, may comprise a first abutment 51, analogous to the first abutment 33 described above, configured to enable a nail to be positioned relative to the support 47, together with a permanent magnet 52 positioned relative to the first abutment 51 in such a manner as to be capable of coming up to a small distance away from the composition that is to be exposed to the magnetic field.

The support 47 may be left in place on the flask 42 while in use. The nail may be pivoted relative to the support 47 until the finger comes into contact with a second abutment 54 formed by the outside surface of the support 47.

Figure 12:
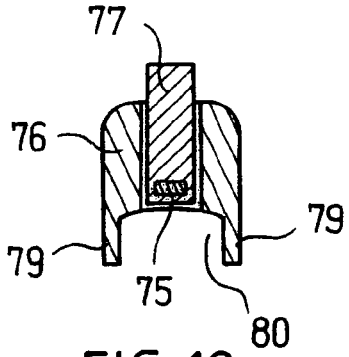
FIG. 12 is a cross-sectional view of another exemplary magnetic device.

FIG. 12 illustrates an exemplary magnetic device in which a magnet 75 is mounted on a support 76 with an option for adjustment in height. For example, the magnet 75 may be secured to a screw 77 configured to enable its distance from a nail to be modified. The user may thus adjust the distance, for example, as a function of the thickness of the finger or the nature of the composition deposited on the nail. As in the example of FIG. 11, tabs 79 may be provided to define a housing 80 for the finger.

Figure 14:
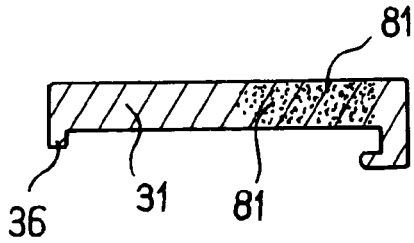

In all cases, the magnet may be a one-piece magnet, or, as illustrated in FIG. 14, may comprise magnetic particles 81 dispersed in a matrix, for example, ferrite particles.

For example, these particles may be incorporated in the material of the support and may be oriented under the action of a magnetic field while the support material is still fluid, so that the effects of the individual fields of the particles are cumulative.

For example, the support material may comprise a thermoplastic material, with the magnetic particles being oriented during molding prior to the thermoplastic material setting.

Figure 15:
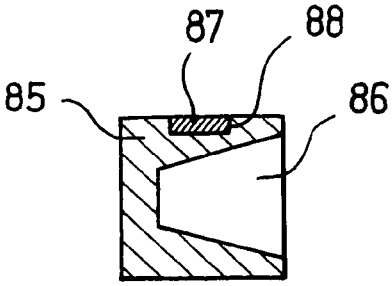
FIG. 15 is a cross-sectional view of another exemplary magnetic device.

FIG. 15 illustrates another exemplary embodiment in which the magnetic device comprises a non-magnetic support 85, for example, made of a thermoplastic material or aluminum, and provided with a housing 86 for receiving the end of a finger.

A magnet 87 may be mounted in a housing 88 of the support in such a manner as to exert a field on the magnetic composition deposited on the nail.

For example, the outside of the support may be generally in the shape of a rectangular block.

Figure 16:
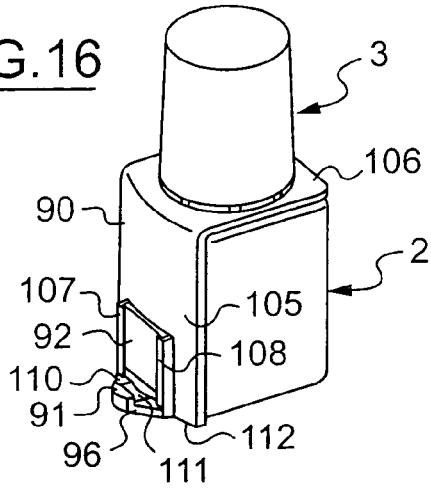

The packaging and applicator device illustrated in FIG. 16 may comprise a support 90 that is configured to be secured to the neck of flask 2, like the support 47 in the example of FIG. 10.

As illustrated in FIG. 16, the flask 2 may include a body of cross-section that is polygonal, specifically square or rectangular, with main faces that are substantially planar.

The support 90 may comprise a front upright 105 that bears against one of the main faces. The front upright 105 may be extended at a top end thereof by a top wall 106 that includes an opening through which the neck of the flask 2 passes.

The support 90 may include a housing configured to receive a permanent magnet 92, for example, that is generally in the form of a rectangular parallelepiped, including sides that are vertical.

The housing of the support 90 may comprise two opposite splines 107 and 108 each provided with an inwardly-directed rim.

The splines 107 and 108 may be configured to form a slideway configured to enable the magnet 92 to be engaged in the housing by a sliding movement, for example, from below and behind the support.

At a bottom end, below the magnet, the support 90 may include a projection 96 that defines a first abutment for positioning a nail relative to the magnet 92.

As illustrated, the projection 96 may include an upwardly-directed rim 91 suitable for bearing against the bottom face of the nail. The rim 91, for example, may include a surface 110 that is directed toward the housing and convex toward the housing.

The top face 111 of the projection 96 may include a upwardly-facing concave setback so as to match substantially the shape of the edge of a nail.

The magnet 92 may be secured on the support in various ways, for example, by snap-fastening via suitable portions in relief on the support, and/or by adhesive.

In the example of FIG. 16, the support 90 may easily be withdrawn from the flask 2 after the applicator 3 has been removed.

The bottom edge 112 may be situated level with the bottom of the flask 2, or a little higher.

Figure 17:
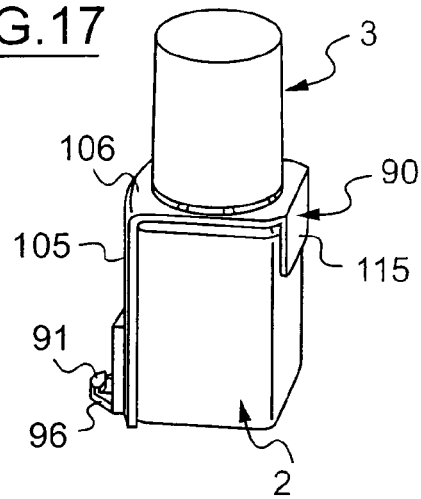

The support 90 in the example of FIG. 17 differs from that illustrated in FIG. 16 by also including a rim 115 extending the top wall 106 downward and bearing against the main face of the flask 2 opposite from the face against which the front upright 105 comes to bear. This may serve to hold the support 90 more securely against turning relative to the flask 2.

The back rim 115, as illustrated, may include a height lying between one-tenth and one-third the height of the main faces of the flask 2. However, in other exemplary embodiments (not shown), the rim 115 may extend, for example, down to the bottom of the flask 2.

Figure 19:
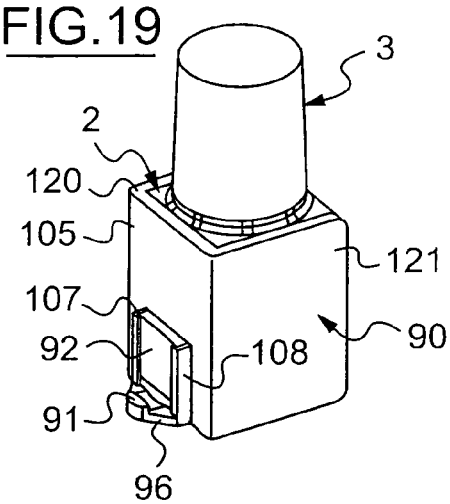

In the example of FIG. 19, the support 90 may include two side flanges 120 and 121 that are connected to the front wall 105 and each of which extends over substantially the full height of the body of the flask 2.

For example, the magnet 92 may be held in the same manner on this support as in the example of FIG. 16, the projection 96 being identical in shape, for example.

Figure 18:
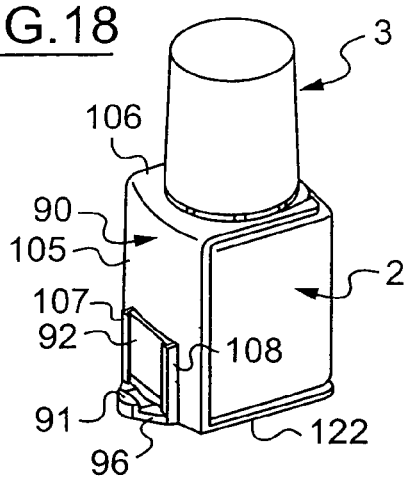

The support 90 illustrated in FIG. 18 may generally be in the form of a clip that is held on the flask 2 by being snap-fastened thereon. In other exemplary embodiments, the support 90 may be held by adhesive or in some other way, for example, as a function of the material from which the flask 2 is made.

The exemplary embodiment of FIG. 18 differs from the example of FIG. 16 by the fact that the front upright 105 is extended at a bottom end by a bottom wall 122 passing under the flask 2 and constituting the stand of the device.

Figure 20:
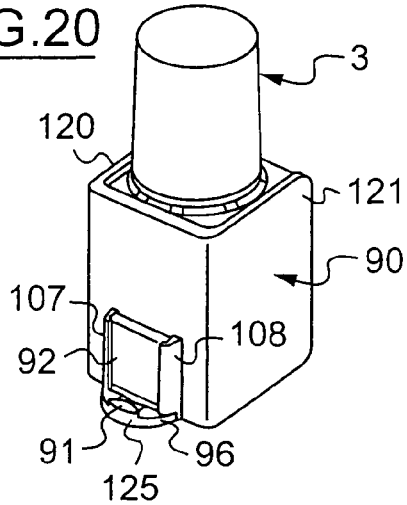

The projection 96 is not restricted to the particular shape illustrated. For example, as illustrated in FIG. 20, the projection 96 may include a rounded front edge 125 that is outwardly convex.

Figure 21:
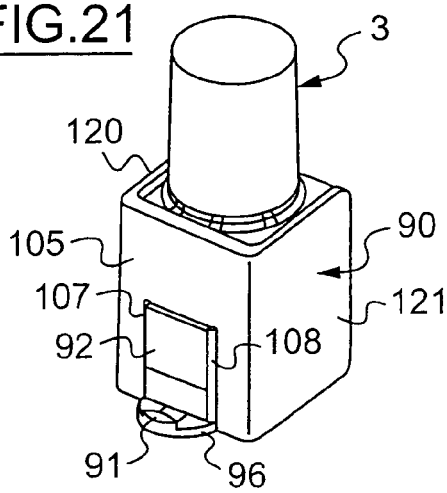

For example, the magnet 92 may be secured to the support 90 by being inserted from in front and from above, for example, being held by being clamped between the splines 107 and 108. In the example of FIG. 21, the magnet 92 may be, for example, merely stuck to the front upright 105 with the splines 107 and 108 serving, for example, to make it easier to position the magnet 92 prior to being stuck in place.

The support 90 may include one or more portions in relief making adhesive bonding easier, for example, constituting traps for adhesive.

Figure 22:
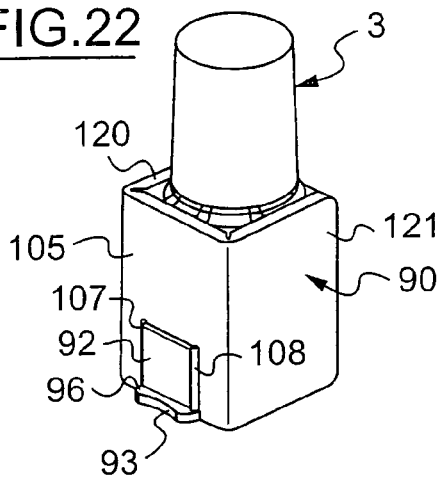

In the example of FIG. 22, the projection may include a front edge with a forwardly-directed concave setback, which may be used for positioning a finger or a nail.

The magnet 92 may be bonded to the support using adhesive as in FIG. 21. However, in other exemplary embodiments, the magnet 92 may be secured in some other way, for example, by snap-fastening or by both snap-fastening and adhesive.

In the examples of FIGS. 23 to 29, the magnet 92 may be oriented on the support in such a manner as to include a front face in the form of a lozenge with a tip 130 thereof pointing downward.

Figure 23:
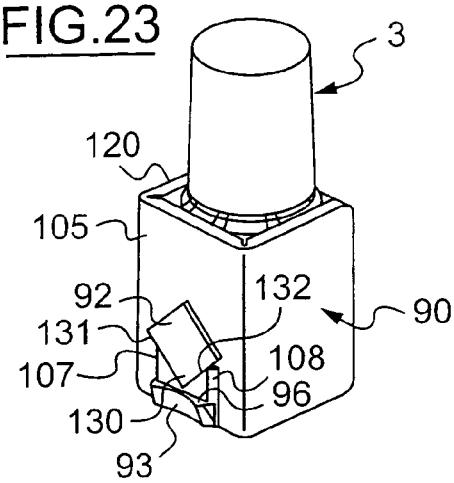

In the example of FIG. 23, the magnet 92 may include two sides 131 and 132 resting on the top ends of the splines 108 and 107, for example, being stuck to the support 90.

In the example of FIG. 22, the projection 96 may include a forwardly-concave setback 93 suitable for positioning a finger or a nail.

For example, the user may position the cuticle adjacent to the lunula in the setback 93 to obtain makeup of the "French manicure" type with a shading effect along the nail due to the gradient of the magnetic field lines created by the magnet.

Figure 35:
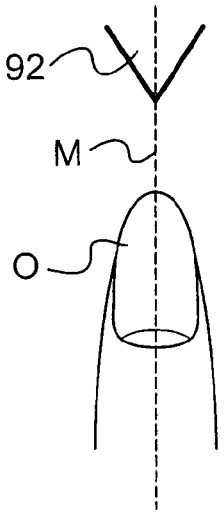
FIG. 35 diagrammatically illustrates, in a plane view, a nail and a magnet.

Generally speaking, it may prove useful to expose the nail to the magnetic field generated by portion of a magnet including a width that varies along a median plane of the nail, as illustrated in FIG. 35. The magnet may be superposed or not at least partially to the nail. The magnet may, for example, include a wedge-shaped portion with sides that taper in the direction of the lunula, the polar faces of the magnet extending, for example, substantially perpendicularly to the median plane of the nail.

Figure 24:
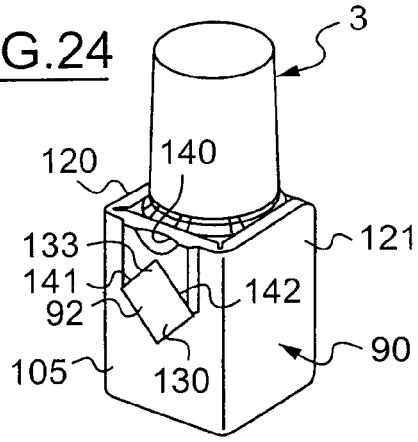
Figure 25:
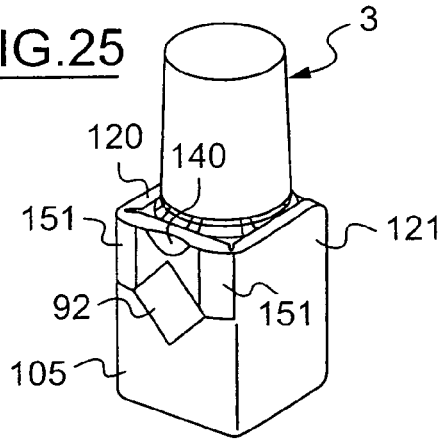

In the example of FIG. 24, the magnet 92 may also include a tip pointing upward, and the support 90 may include a setback 140 in the top portion of the front upright 105 suitable for positioning a finger or a nail.

It may be advantageous for the magnet 92 to be located in the top portion of the support 90. Compared with the example of FIG. 23, that may make it possible to avoid any need to pick up the flask to position the nail or the finger on the support.

The magnet 92 may be secured in a housing defined by extra thickness of the front upright 105, with the magnet 92 coming to bear, for example, via top sides 141 and 142 thereof against a step in the front upright 105.

The examples of FIGS. 25, 26, 27, and 28 differ from that of FIG. 24 in the appearance of the front upright 105.

Figure 26:
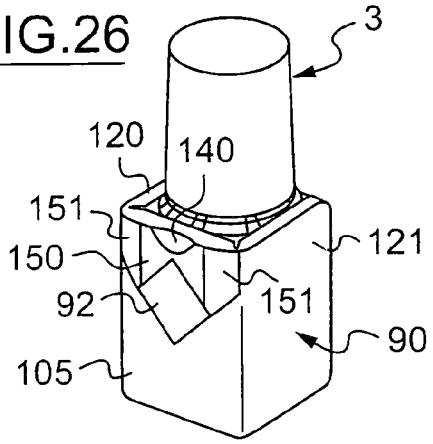

In the example of FIG. 26, a lightly concave region 150 may be formed between two thicker side strips 151, which may make it easier for the user to see the location where to put the nail.

Figure 27:
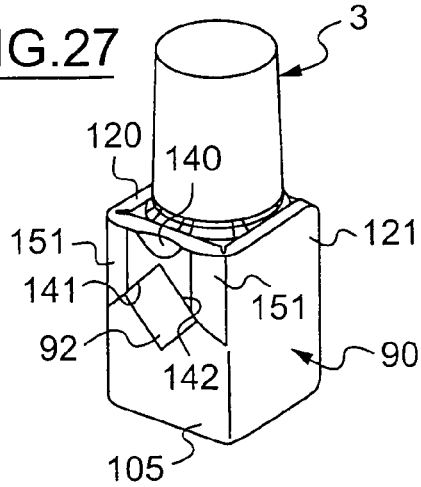

In the example of FIG. 27, the strips 151 may include oblique ends that extend the sides 141 and 142 of the magnet 92.

In the example of FIG. 28, the strips 151 may extend over substantially the full height of the support 90.

In the example of FIG. 29, the front upright 105 may include a central spline 160 in a top portion thereof and the magnet 92 may include its sides 141 and 142 pressing against a fork formed in the bottom end of the spline 160. The top portion of the spline 160 may include a setback 95 that is lightly concave toward the front and that serves to position the nail.

In all of the examples in which the support is generally in the form of a clip, one or both of the side flanges 120 and 121 may include a rim at the end pointing toward the other flange so as to hold the support 90 on the flask.

The supports illustrated in FIGS. 31 to 34 may comprise such a rim in the form of a rim 98 parallel to the front upright. In other exemplary embodiments (not shown), the rim may itself be in the form of a chamfered spline.

As illustrated in FIG. 32, the flanges may include at least one portion in relief such as a lip 99 configured to enable the support to be clipped onto the flask 2 at the end of a sliding movement along the longitudinal axis of the flask 2.

When included, the projection 96 may extend over the entire width of the front upright 105, for example, as illustrated in FIG. 31. As illustrated in FIG. 31, rims 165 may be formed at the front ends of the splines 107 and 108 and configured to hold the magnet 92 (not illustrated). There may also be portions in relief 70 such as lips made in the facing faces of the splines, for example, to hold the magnet in the corresponding housing 97 of the support by friction.

In other exemplary embodiments, or in addition, the splines may comprise hollow portions in relief so as to form traps for adhesive.

In the example of FIG. 31, the magnet may be held in the housing 97 formed by the splines 107 and 108, for example, by being inserted from the front and from above.

In the example of FIG. 32, the housing 97 may open into the bottom of the support and the magnet may be inserted through the corresponding opening 182.

Figure 33:
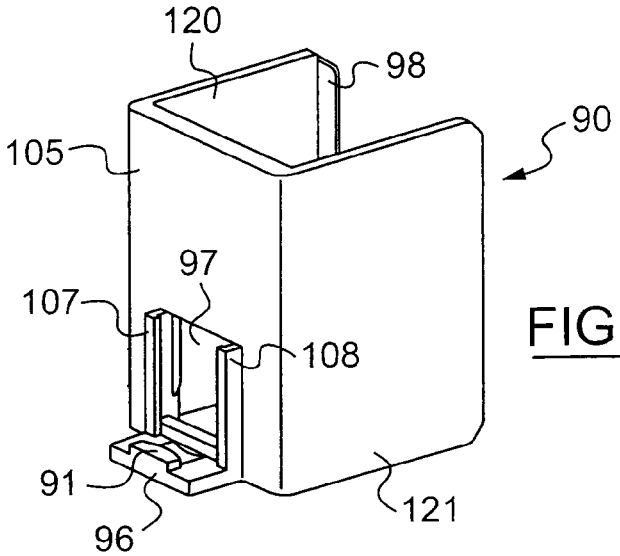

In the example of FIG. 33, the projection 96 may include a front edge that is substantially flat and parallel to the front upright 105.

Figure 34:
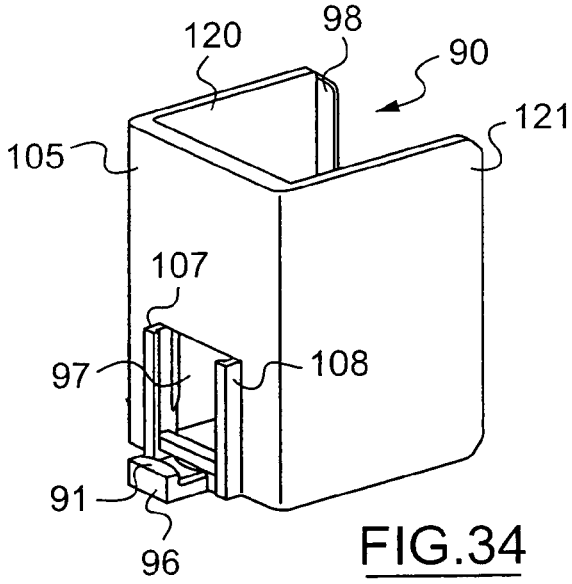

In the example of FIG. 34, the projection 96 may be narrower than the distance between the splines 107 and 108. The top edge of the support may be chamfered, for example, beside the inside face of the front upright 105 or in the top corners of the flanges 120 and 121, for example, to make it easier to put the flask into place, to improve appearance, and/or to make the support less vulnerable to impacts.

Naturally, the various details of the examples illustrated may be combined with one another. For example, in other exemplary embodiments not illustrated, provision may be made for one of the means for mounting the support on the flask to be combined with any one of the means for mounting the magnet on the support and any one of the means for positioning the nail relative to the magnet.

In any of the examples of FIGS. 16 to 34, the support 90 may comprise information representative of a motif that can be made, for example, in the form of a pattern made using the composition, or reproduced on a label stuck onto the support, or made by printing on the support.

The support 90 may include some other shape, for example, adapted to a flask 2 including a body that is cylindrical or frustoconical in shape.

Where appropriate or desired, the support 90 may be made with a hinge and a moving portion that may be pivoted between a configuration that enables the support to be put into place on the flask, and a position configured to hold the flask to the support.

The support may be provided with a plurality of magnets, for example, including magnetic properties that are different to create different patterns.

Where appropriate or desired, the support may be made with an adjustable portion configured to enable the support to be fitted to flasks of several sizes and/or to engage fingers or nails of several sizes and/or to include various types of pattern to be made.

In the examples illustrated in FIGS. 16 to 29, the device may comprise an applicator 3 provided with a stem including an applicator element at one end, such as a brush, and a handle member at its other end, the handle member also constituting a cap configured to close the flask 2.

In other exemplary embodiments (not shown), the flask may not include an applicator 3, with the composition being applied by means other than a brush inserted into the flask, for example, by making direct use of a dispenser orifice of the flask.

The invention is not limited to the embodiments described above.

For example, the shape of the permanent magnets may be modified and may be provided with drive means configured to enable the permanent magnets to rotate about an axis, thus serving to provide patterns with the appearance of a sphere, for example.

The permanent magnets may be replaced by at least one electromagnet.

The term "comprising a" should be understood as being synonymous with "comprising at least one" unless specified to the contrary. "flask" and "container" are synonymous.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A packaging and applicator assembly, comprising:

a container;

a nail varnish composition for application to a nail contained in the container, the composition comprising magnetic bodies;

an applicator removably affixed to the container and configured to apply at least one layer of the nail varnish to a top surface of the nail; and a magnetic device, to the container and operable independently of the applicator, the magnetic device producing a static magnetic field and having a rim configured to bear against an inside face of the nail to enable pivoting about the nail such that the magnetic device overlies the at least one layer of the nail varnish on the top surface of the nail without contacting the nail varnish, resulting in formation of a pattern on the at least one layer of the nail varnish deposited on the nail according to the static magnetic field of the magnetic device.

2. The assembly according to claim 1, wherein the magnetic device is removably affixed to the container.

3. A packaging and applicator assembly, comprising a flask, a nail varnish composition for application to a nail contained in the flask, the composition comprising magnetic bodies, an applicator removably affixed to the flask and configured to apply at least one layer of the nail varnish to a top surface of the nail; and a magnet carried by a support affixed to the flask and operable independently of the applicator, the magnet producing a static magnetic field resulting in formation of a pattern on the at least one layer of the nail varnish deposited on the nail according to the static magnetic field of the magnet, the magnet being bounded to the support by at least one of adhesive, snap-fastening and sliding engagement.

4. The assembly according to claim 3, the support being snap-fastened on the flask.

5. The assembly according to claim 3, the support being held by adhesive on the flask.

6. The assembly according to claim 3, the support comprising splines each provided with an inwardly directed rim, the splines defining a housing configured to receive the magnet by a sliding engagement.

* * * * *